US010863879B2

(12) United States Patent
Cullins

(10) Patent No.: US 10,863,879 B2
(45) Date of Patent: Dec. 15, 2020

(54) APPARATUS AND METHODS FOR ILLUMINATING A BROOM OR MOP

(71) Applicant: Jamiel C. Cullins, Portland, OR (US)

(72) Inventor: Jamiel C Cullins, Portland, OR (US)

( * ) Notice: Subject to any disclaimer, the term of this patent is extended or adjusted under 35 U.S.C. 154(b) by 0 days.

(21) Appl. No.: 16/254,360

(22) Filed: Jan. 22, 2019

(65) Prior Publication Data

US 2020/0229671 A1 Jul. 23, 2020

(51) Int. Cl.

| | |
|---|---|
| ***A47L 13/50*** | (2006.01) |
| ***F21V 21/14*** | (2006.01) |
| ***A46B 17/08*** | (2006.01) |
| ***F21V 21/088*** | (2006.01) |
| ***A47L 13/20*** | (2006.01) |

(52) U.S. Cl.

CPC ..... *A47L 13/50* (2013.01); *A46B 17/08* (2013.01); *A47L 13/20* (2013.01); *F21V 21/0885* (2013.01); *F21V 21/145* (2013.01)

(58) Field of Classification Search

CPC ..... A47L 13/20; A47L 13/50; A46B 17/08; F21V 21/088; F21V 21/0885

See application file for complete search history.

(56) References Cited

U.S. PATENT DOCUMENTS

| | | | | |
|---|---|---|---|---|
| 3,134,129 | A * | 5/1964 | Allen | A47L 13/24 401/138 |
| 6,802,633 | B1 * | 10/2004 | VandenBossche | B63B 17/00 362/191 |
| 8,707,499 | B2 | 4/2014 | Clark | |
| 2006/0133074 | A1 * | 6/2006 | Lai | F21V 21/06 362/205 |
| 2006/0203476 | A1 * | 9/2006 | Chapman | F21V 5/048 362/157 |
| 2016/0161069 | A1 * | 6/2016 | Lam | F21L 4/027 362/205 |

FOREIGN PATENT DOCUMENTS

| | | | |
|---|---|---|---|
| CN | 201453167 | U | 7/2009 |
| CN | 202051661 | U | 5/2011 |
| CN | 202104872 | U | 5/2011 |
| CN | 202122549 | U | 6/2011 |
| CN | 202313146 | U | 10/2011 |
| CN | 202843530 | U | 9/2012 |
| CN | 202981903 | U | 6/2013 |
| CN | 207017211 | U | 5/2017 |

* cited by examiner

*Primary Examiner* — Isiaka O Akanbi
*Assistant Examiner* — Nathaniel J Lee

(57) ABSTRACT

A method and apparatus for illuminating a broom or mop, the method includes providing a mount. The mount has a first adjustable rod clamp, the adjustable rod clamp having an opening sufficiently large to hold a broom or mop handle, the first adjustable rod clamp attached to a second rod clamp by an articulating joint. The articulating joint allowing at least rotation between the first rod clamp and the second rod clamp. The second rod clamp has an opening sufficiently large to hold a flashlight. The method further includes mounting the first adjustable rod clamp on a broom or mop and mounting a flashlight on the second rod clamp.

19 Claims, 5 Drawing Sheets

APPARATUS AND METHODS FOR ILLUMINATING A BROOM OR MOP

TECHNICAL FIELD OF THE DISCLOSURE

The present disclosure relates in general to an apparatus and method for holding rod shaped devices.

BACKGROUND DISCUSSION

The cleaning industry and related cleaning industry products are continually evolving with innovative products. New cleaning apparatus and methods of cleaning are introduced to the market every year. These innovations are typically new convenience products such as convenience dispensable and more advanced automated methods of cleaning, including autonomous cleaners. In contract, little attention is paid to improving the manual methods of cleaning. Indeed, classic methods of cleaning, including manual sweeping and mopping have not seen much attention. One issue with such manual methods include illumination of the area needed to be cleaned.

While the Applicant is not aware of current innovations in this field, a variety of solutions have been previously presented. For instance, most cleaning apparatus such as vacuums cleans have integrated lighting. Others skilled in the art have provided integrated lighting solutions for brooms and mops. For instance, Chinese patents CN202313146, CN202051661, and CN201453167 provide integrated mounts to hold illuminating devices onto a broom. These solutions have integrated mounts designed into the broom or mop handle itself, or otherwise must be installed with semi-permanent hardware. While these solutions provide a solution to the given issue, none have been adopted by the industry as known to the Applicant.

The present Applicant and associated and associated innovation described below, provide a new approach.

SUMMARY OF THE DISCLOSURE

The present disclosure is directed to a method and an apparatus for illuminating a broom or mop, the method includes providing a mount. The mount has a first adjustable rod clamp, the adjustable rod clamp having an opening sufficiently large to hold a broom or mop handle, the first adjustable rod clamp attached to a second rod clamp by an articulating joint. The articulating joint allowing at least rotation between the first rod clamp and the second rod clamp. The second rod clamp has an opening sufficiently large to hold a flashlight. The method further includes mounting the first adjustable rod clamp on a broom or mop and mounting a flashlight on the second rod clamp.

BRIEF DESCRIPTION OF THE DRAWINGS

The accompanying drawings, which are incorporated in and constitute a part of the specification, schematically illustrate embodiments of the present disclosure, and together with the general description given above and the detailed description of preferred methods and embodiment given below, serve to explain principles of the present disclosure.

DETAILED DESCRIPTION

Figure 1:
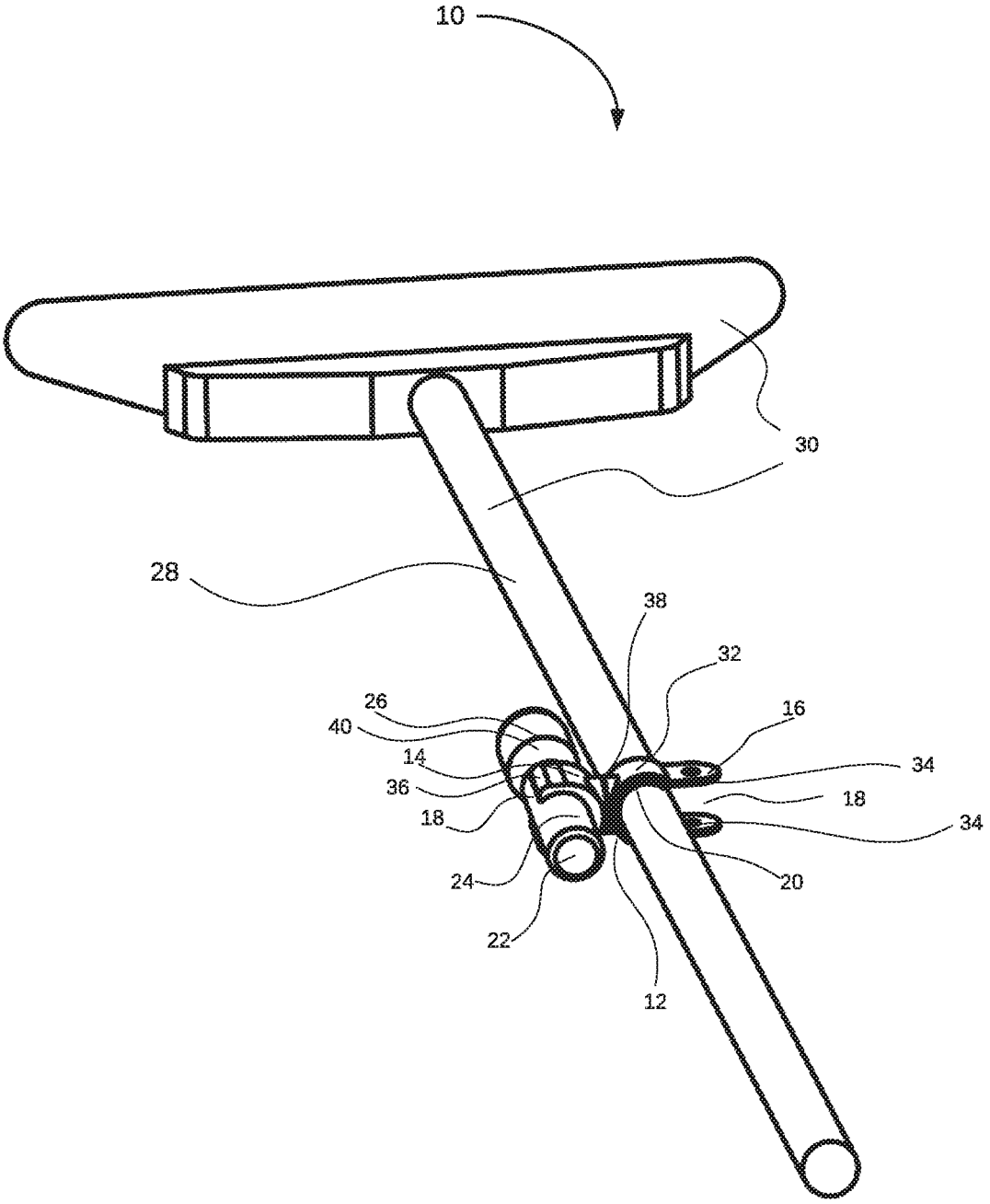
FIG. 1 is a perspective view of an apparatus of the present disclosure that includes a mount, the mount having a first adjustable rod clamp, the adjustable rod clamp having an opening sufficiently large to hold a broom or mop handle, the first adjustable rod clamp attached to a second rod clamp by an articulating joint, the articulating joint allowing at least rotation between the first rod clamp and the second rod clamp, the second rod clamp having an opening sufficiently large to hold a flashlight.

Referring now to the drawings, wherein like components are designated by like reference numerals. Methods of manufacture and various embodiments of the present disclosure are described further herein below.

Figure 2:
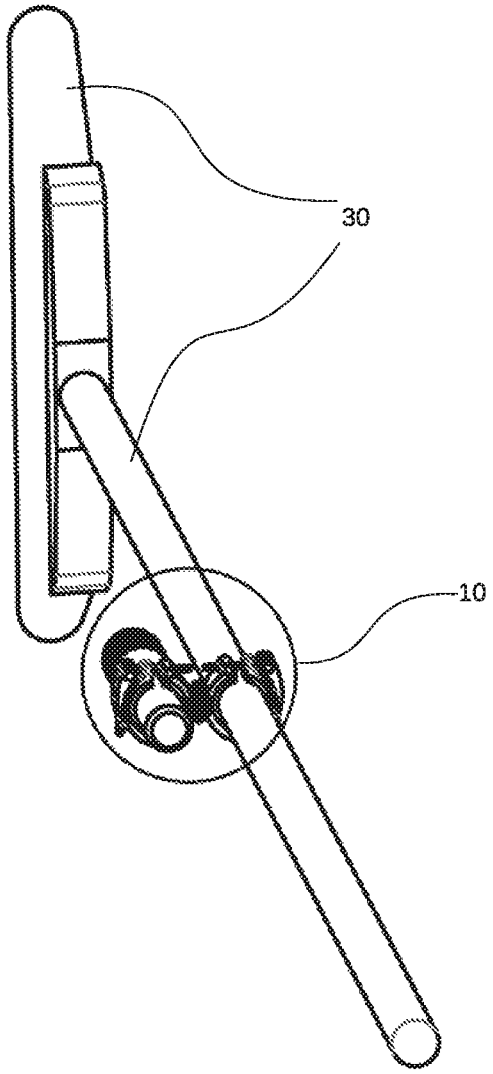
FIG. 2. is a perspective view of the apparatus as that shown in FIG. 1.
Figure 3:
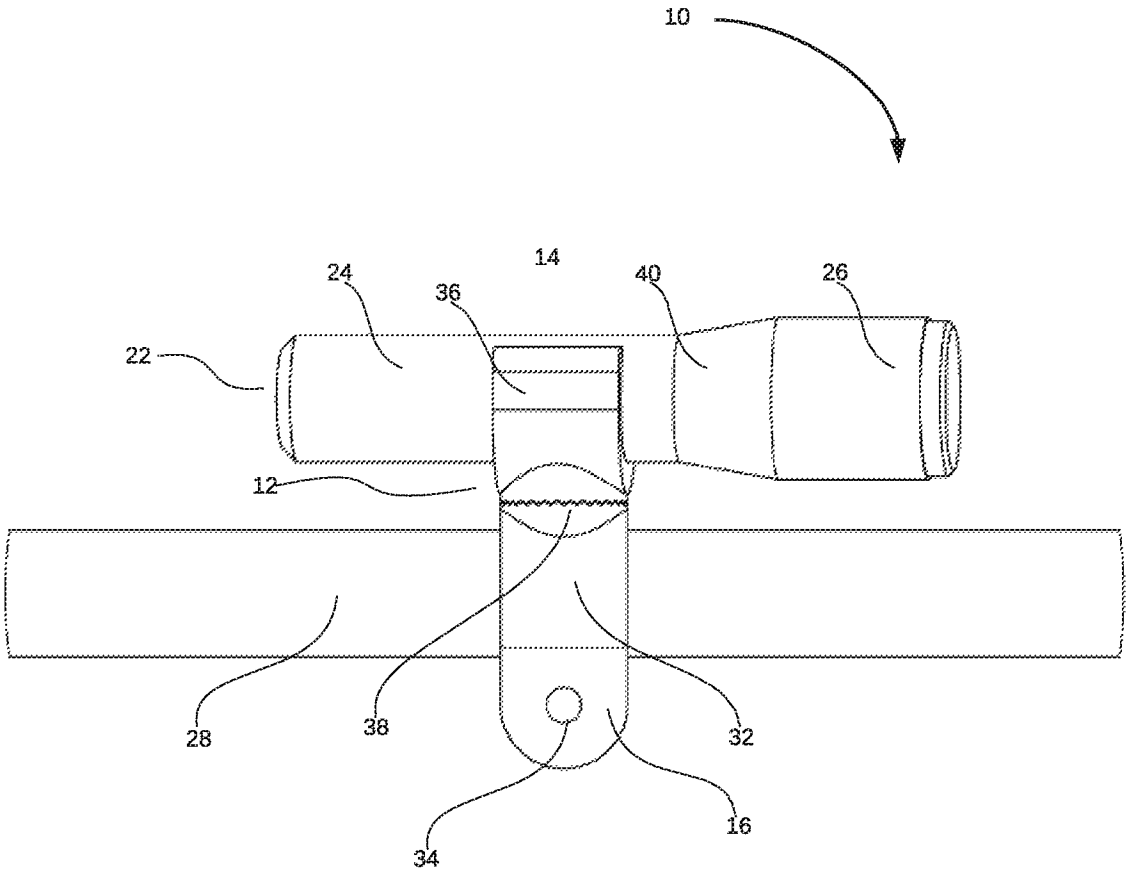
FIG. 3 is a side view of the apparatus shown in FIG. 1.

Referring to FIG. 1, FIG. 2, and FIG. 3 a number of schematic illustrations of provide an example embodiment of an apparatus for cleaning 10 comprising a broom or mop 30 having a rod shaped handle 28, an illuminating member 40, and a mount 12 that holds the broom or mop 30 and the illuminating member 40.

The broom or mop 30 has a rod shaped handle 28 may also be a sweeper. The rod shaped handle 28 may be made of any material suitable to act as a handle such as plastic, aluminum, titanium, stainless steel, or PVC pipes.

The rod shaped handle 28 may be extendable via means of a spring loaded mechanism in order to facilitate ease of use during mopping or sweeping. The rod shaped handle 28 may also be extendable via means of a linear actuator mechanism wherein the rod shaped handle 28 comprises a threaded member 20 such that rotation of the rod shaped handle 28 extends the length of the handle from a first position to a second position. The extendable rod shaped handle 28 may extend from a first position to a second position wherein the second position is at a greater length than the first position.

The illuminating member 40 may be a flashlight, a light emitting device (LED), or any member that illuminates. The illuminating member 40 comprises a portion of the body wherein it is rod shaped.

A mount 12 comprises of a first adjustable rod clamp 32 and a second adjustable rod clamp 14. The first adjustable rod clamp 32 has an opening 18 sufficiently large enough to hold a broom or mop 30 having rod shaped handle 28. The first adjustable rod clamp 32 comprises a cam member 16 to secure the rod shaped handle 28. The cam member 16 or the first adjustable rod clamp 32 comprises a threaded member 20 to secure the broom or mop 30. The first adjustable rod clamp 32 or the cam member 16 may also comprise upper and lower holes 34 large enough for a screw member to be inserted and fastened by a threaded nut.

The second adjustable rod clamp 14 comprises a cam arm 36 to secure the illuminating member 40. The second adjustable rod clamp 14 has an opening 18 that may be deformable. The cam arm 36 may be flexible and may be made of any material that retains its flexibility. The cam arm 36 may be made of PVC, aluminum, copper, or any plastic material. The second adjustable rod clamp 14 may further comprise of a deformable pad to secure the illuminating member 40. The illuminating member 40 may be inserted into at second adjustable rod clamp 14 via forcing the cam arm 36 into position to wrap around the rod shaped portion 24 of the illuminating member 40 or sliding the illuminating member 40 into the opening 18.

In another example, des the mount 12 holds the rod shaped portion 24 of the illuminating member 40 via a second adjustable rod clamp 14 having a cam arm 36 that is deformable. The rod shaped portion 24 of the illuminating member 40 may slidably attach to the second adjustable rod clamp 14 having deformable cam arm 36. In yet another example, the rod shaped portion 24 may also attach to the second adjustable rod clamp 14 when either the rod shaped portion 24 or the cam arm 36 is urged against each other and the rod shaped portion 24 snaps into position at opening 18.

Referring to FIG. 2, a perspective view of an example apparatus for cleaning 10 comprising a broom or mop 30, an illuminating member 40, and a mount 12 wherein the mount 12 is attached to a broom or mop 30 at the rod shaped handle 28 and the rod shaped portion 24 of the illuminating member 40. The broom or mop 30 may or may not have any mounting hardware for the mount 12 thereby allowing the mount 12 to hold the broom or mop 30 directly at the rod shaped handle 28.

Referring to FIG. 3. FIG. 3 is a schematic illustration of a profile view of an example apparatus for cleaning 10 comprising a mount 12, wherein the mount 12 is holding both a rod shaped handle 28 of a broom or mop 30 and an illuminating member 40. The mount 12 comprises an articulating joint 38 wherein the articulating joint 38 joins a first adjustable rod clamp 32 and a second adjustable rod clamp 14 thereby allowing at least partial rotation between the first adjustable rod clamp 32 and the second adjustable rod clamp 14. The articulating joint 38 may have 360 degree freedom of rotation. The articulating joint 38 may have fluid movement and/or indexed rotational positions. The articulating joint 38 is indexed at less than 90 degrees.

The illuminating member 40 may be a flashlight having at least 700 lumens. In another example, the illuminating member 40 may be a flashlight having at least 900 lumens. The illuminating member 40 may comprise of a light emitting diode (LED), universal serial bus (USB) port to receive energy via a USB connector, a rear end 22 whereby a lid to a battery compartment or a USB port may be located, an illuminating head 26 whereby the LED light source may be housed or a battery compartment may be accessed, a brightness adjuster which may be located on the rod shaped portion 24, or on the rear end 22 or the illuminating member 40. The brightness of the illuminating member 40 may also be adjusted via rotation of the illuminating head 26.

Figure 4A:
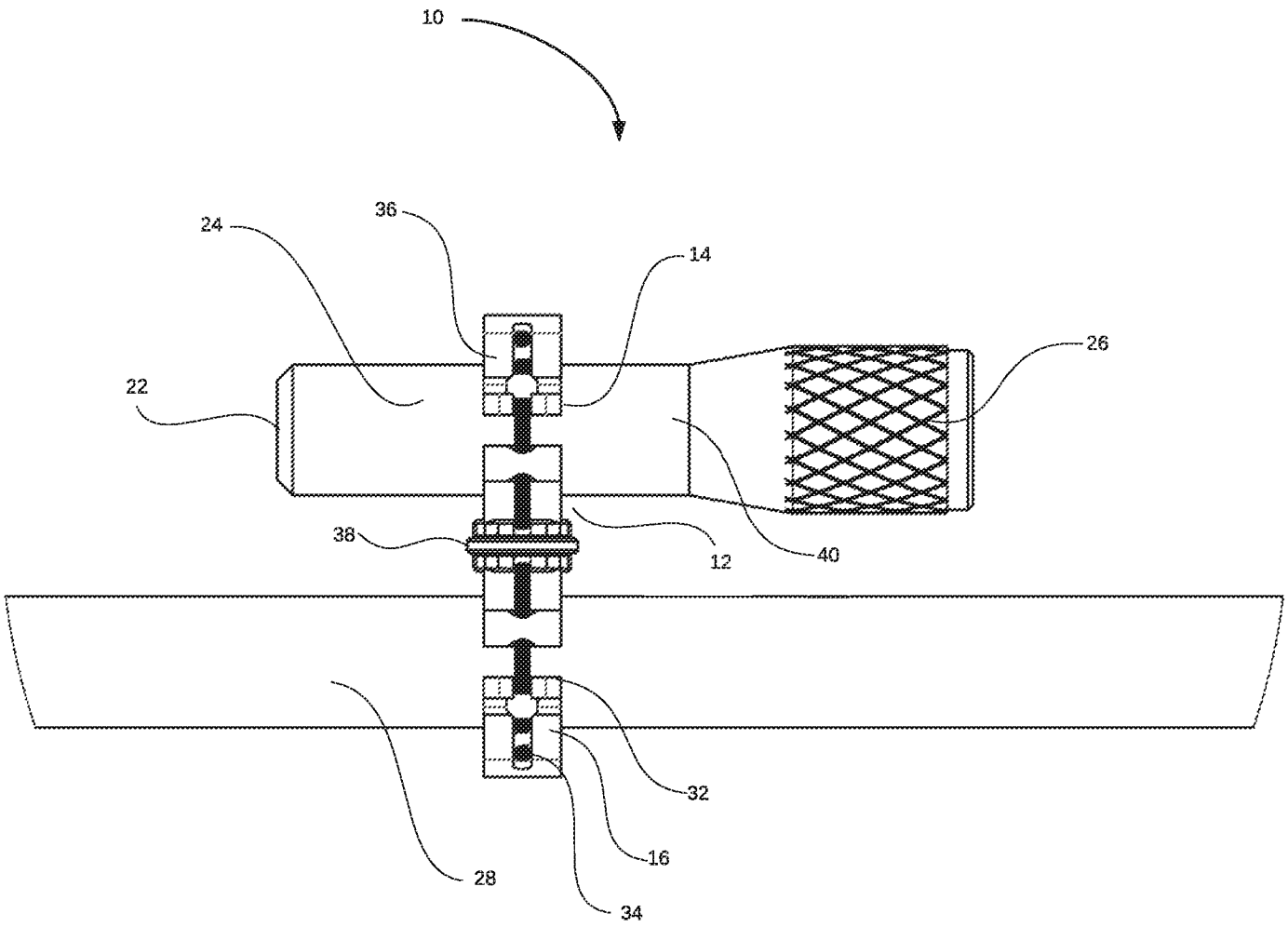
FIG. 4A is a side view of another embodiment of the apparatus of the present invention similar to that shown in FIG. 1, except here the mount has a first adjustable clamp and a second adjustable clamp with a cam lever.
Figure 4B:
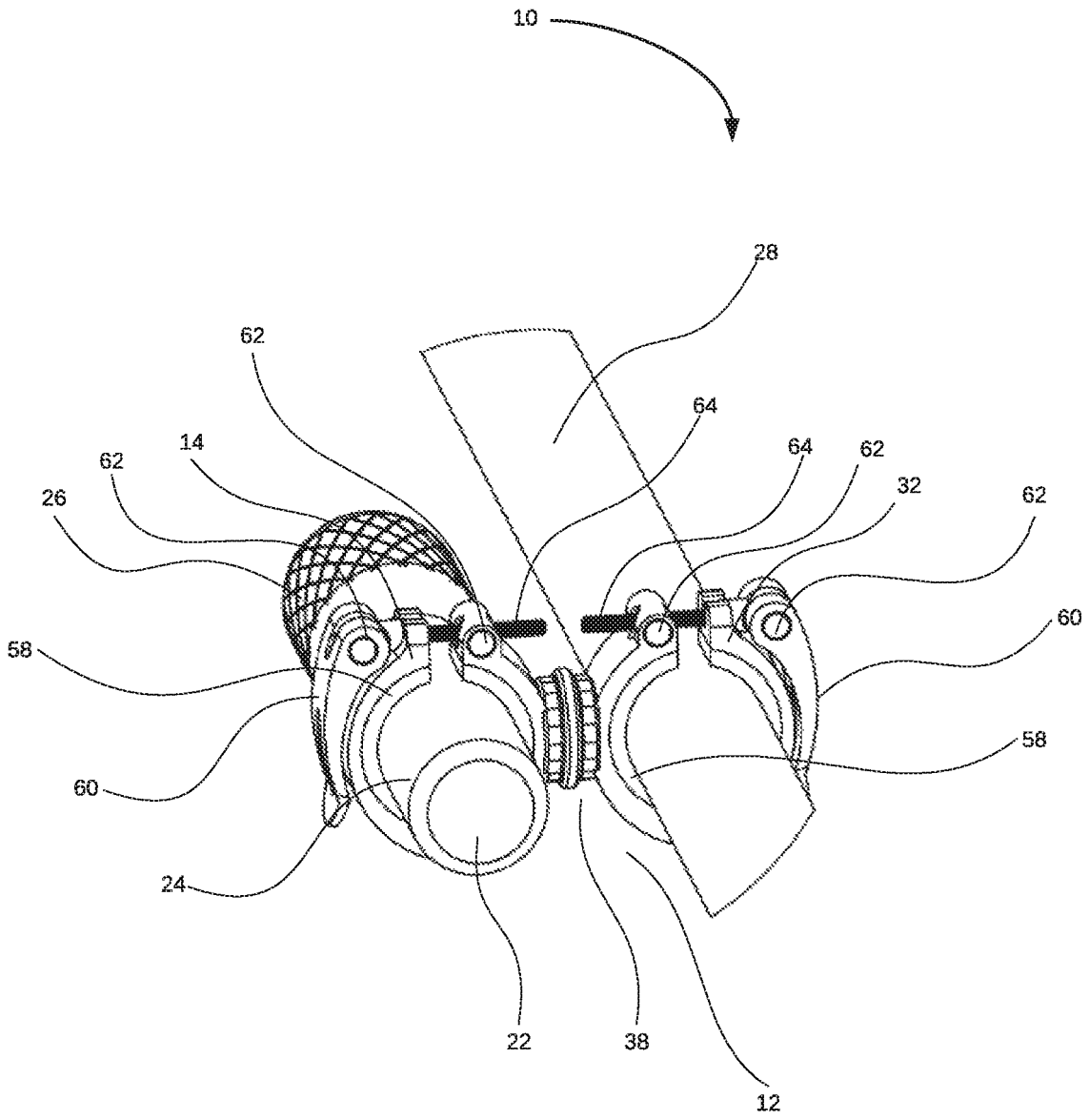
FIG. 4B is a perspective view of the embodiment shown in FIG. 4A

Referring to FIG. 4, wherein FIG. 4A is a schematic illustration of a profile view and FIG. 4B is a schematic illustration of a perspective view of another example apparatus for cleaning 10 comprising a mount 12, wherein the mount 12 is holding both a rod shaped handle 28 of a broom or mop 30 and an illuminating member 40. The mount 12 comprises an articulating joint 38 wherein the articulating joint 38 joins a first adjustable rod clamp 32 and a second adjustable rod clamp 14 thereby allowing at least partial rotation between the first adjustable rod clamp 32 and the second adjustable rod clamp 14. The articulating joint 38 may have 360 degree freedom of rotation. The articulating joint 38 may have fluid movement and/or indexed rotational positions. The articulating joint 38 is indexed at less than 90 degrees.

The mount 12 in FIG. 4 may secure clamp devices which are a broom or mop 30 and an illuminating member 40 using a cam lever 60 that pivotably locks or unlocks rotating about a pivot pin 62. The cam lever 60 engages a threaded rod 64 to secure the clamped device which may be an illuminating device or broom or mop 30. A rod shaped handle 28 of the broom or mop 30 may slide into a first adjustable rod clamp 32 where the first adjustable rod clamp 32 is sufficiently large enough when the cam lever 60 is in its unlock position. A rod shaped portion 24 of the illuminating member 40 may also slide into a second adjustable rod clamp 14 where is cam lever 60 of the second adjustable rod clamp 14 is in its open position. To achieve its open or unlock position, the cam lever 60 engages the threaded rod 64 allowing the first or second adjustable rod clamp's 14 diameter to increase thereby allowing sufficient opening 18 for either the illuminating member 40 or the rod shaped handle 28 to slide into either the first or second adjustable rod clamp 14. To achieve its closed or locked position, the cam lever 60 engages the threaded rod 64 urging the first or second adjustable rod clamp's 14 diameter to decrease thereby securing either the illuminating member 40 or the rod shaped handle 28 to the mount 12. The illuminating member 40 or the rod shaped handle 28 may further be secured by a padded member 58. The padded member 58 may be rubber or any polymer. The padded member 58 may also be a threaded member 20.

The illuminating member 40 may be a flashlight having at least 700 lumens. In another example, the illuminating member 40 may be a flashlight having at least 900 lumens. The illuminating member 40 may comprise of a light emitting diode (LED), universal serial bus (USB) port to receive energy via a USB connector, a rear end 22 whereby a lid to a battery compartment or a USB port may be located, an illuminating head 26 whereby the LED light source may be housed or a battery compartment may be accessed, a brightness adjuster which may be located on the rod shaped portion 24, or on the rear end 22 or the illuminating member 40. The brightness and or area of light emission from the illuminating member 40 may also be adjusted via rotation of the illuminating head 26. In general, the beam width angle is adjustable by changing the distance between any element emitting light and any optics inside the illumination head. The illuminating head 26 may further have a lateral surface wherein the lateral has a knurled grip.

The illuminating members described in the embodiments can has a variety of features. In some embodiments the illuminating member has a first digit IP rating of 4. In other embodiments the IP rating is preferably 5, 6, or 7. Relatedly, the second digit IP rating is greater than 2. In embodiments that have potential exposure to liquid spray, the second IP rating is preferably larger than 5. In embodiments that have potential for submersion, the second digit IP rating is preferably larger or equal to 6. In addition, the illuminating member can have a variety of beam width angles.

As described, the apparatus shown in the figures have mounts with a first adjustable that are not integrated into the broom or mop handle. Thus, the broom or mop, or the flashlight can be removed easily for storage, or charging of the illuminating member. Further, when using the disclosed apparatus, a user can equip the mount at any location along a rod shaped handle. Given the beam width angle, the user can increase or decrease the area of illumination by moving the mount along the rod length.

From the description of the present invention provided herein one skilled in the art can manufacture the apparatus and practice the methods in accordance with the present disclosure. Those skilled in the art to which the present invention pertains will recognize that while above-described embodiments and method of manufacture are exemplified using particular materials, others may be combined using these embodiments without departing from the spirit and scope of the present invention. Although some of the embodiments explained above have certain symmetry one skilled in the art will recognize that such symmetry is not a requirement. In summary, the present invention is described above in terms of particular embodiments. The invention, however, is not limited to the embodiments described and depicted herein. Rather, the invention is limited only by the claims appended hereto.

What is claimed is:

1. A method of illuminating a broom or mop, the method comprising:

providing a mount, the mount having a first adjustable rod clamp, the adjustable rod clamp having an opening sufficiently large to hold a broom or mop handle, the first adjustable rod clamp attached to a second rod clamp by an articulating joint, the articulating joint allowing at least rotation between the first rod clamp and the second rod clamp, wherein the articulating joint has indexed rotational positions, the second rod clamp having an opening sufficiently large to hold a flashlight;

mounting the first adjustable rod clamp on a broom or mop; and mounting a flashlight on the second rod clamp.

2. The method of claim 1, wherein the mount is adjusted along the length of the broom to illuminate an area.

3. The method of claim 1, wherein the flashlight has at least 700 lumens.

4. The method of claim 1, wherein the first adjustable rod clamp has a cam member to secure the broom or mop handle.

5. The method of claim 1, wherein the flashlight has an IP rating of XY, wherein X is the first digit IP code and Y is the second digit IP code, and X is at least 4 and Y is at least 5.

6. The method of claim 1, wherein second adjustable rod clamp has a cam arm member to secure the flashlight.

7. The method of claim 6, wherein the second adjustable rod clamp opening has a deformable pad to secure the flashlight.

8. The method of claim 1, wherein the articulating joint has 360-degree freedom of rotation.

9. The method of claim 1, wherein the broom or mop does not have any additional mounting hardware for the mount.

10. An apparatus for cleaning, the apparatus comprising:

a broom or mop having a rod shaped handle;

a flashlight, at least a portion of the flashlight's body having a rod shape;

a mount, the mount having a first adjustable rod clamp, the first adjustable rod clamp having an opening sufficiently large to hold the broom or mop handle;

a second adjustable rod clamp, the second adjustable rod clamp having an opening sufficiently large to hold the flashlight;

an articulating joint, the articulating joint joining the first adjustable rod clamp to the second adjustable rod clamp, thereby allowing at least partial rotation between the first rod clamp and the second rod clamp wherein the articulating joint has indexed rotational positions.

11. The apparatus of claim 10, wherein the first adjustable rod clamp has a threaded member to secure the broom or mop handle.

12. The apparatus of claim 10, wherein the first adjustable rod clamp has a cam member to secure the broom or mop handle.

13. The apparatus of claim 10, wherein the second adjustable rod clamp has an opening that is deformable.

14. The apparatus of claim 10, wherein second adjustable rod clamp has a cam arm member to secure the flashlight.

15. The apparatus of claim 14, wherein the second adjustable rod clamp opening has a deformable pad to secure the flashlight.

16. The apparatus of claim 10, wherein the articulating joint has 360-degree freedom of rotation.

17. The apparatus of claim 10, wherein the articulating joint has fluid movement.

18. The apparatus of claim 10, wherein the articulating joint is indexed at less than 90 degrees.

19. The apparatus of claim 10, wherein the flashlight has at least 700 lumens.

* * * * *